US007006644B1

(12) United States Patent
Sudolcan

(10) Patent No.: US 7,006,644 B1
(45) Date of Patent: Feb. 28, 2006

(54) AUDIO DISPENSING VALVE FOR A BEVERAGE DISPENSER

(75) Inventor: Paul S. Sudolcan, Seguin, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/377,045

(22) Filed: Aug. 19, 1999

(51) Int. Cl.
*G09F 27/00* (2006.01)
*B67D 5/32* (2006.01)
*B67D 5/56* (2006.01)

(52) U.S. Cl. ..... 381/124; 222/39; 222/129.1

(58) Field of Classification Search ..... 381/124; 222/39, 129.1
See application file for complete search history.

(56) References Cited

U.S. PATENT DOCUMENTS 3,647,115 A * 3/1972 McCann et al. ..... 222/39
5,129,434 A * 7/1992 Whigham et al. ..... 141/362
5,908,142 A * 6/1999 Sacchetti ..... 222/25
6,125,482 A * 10/2000 Foster ..... 4/623

* cited by examiner

*Primary Examiner*—Vivian Chin
*Assistant Examiner*—Devona E Faulk
(74) *Attorney, Agent, or Firm*—Christopher L. Mackay

(57) ABSTRACT

An audio dispensing valve for a beverage dispenser including a valve for regulating fluid flow through the audio dispensing valve and a switch in operative engagement with the valve for selectively activating the valve. The audio dispensing valve also includes an audio unit linked with the switch for providing audio information as the switch and valve are activated.

9 Claims, 3 Drawing Sheets

AUDIO DISPENSING VALVE FOR A BEVERAGE DISPENSER

BACKGROUND OF THE INVENTION

1. Field of the Invention

The present invention generally relates to dispensing equipment and, more particularly, but not by way of limitation, to a dispensing valve for a beverage dispenser that emits audible information therefrom.

2. Description of the Related Art

Soft drink beverage dispensers are growing in popularity and availability. From fast-food restaurants to multiplex movie theaters, the use of soft drink beverage dispensers is expanding into many new commercial markets. As a result, more people than ever before enjoy today's convenience of selecting a beverage of choice from an array of different drink flavors. Typically, a beverage dispenser features several dispensing valves whereby each dispensing valve is assigned a single drink flavor. By placing a cup under a dispensing valve and activating its nozzle via a lever interface, the valve dispenses the desired flavored drink into the cup at a preset volume and temperature.

In these new commercial settings, however, many new consumer demands have been imposed on beverage dispensers. For example, there is a demand to design a beverage dispenser that can sufficiently indicate merchandising information to a large number customers.

Specifically, today's beverage dispensers only feature small visual indicators that display the availability of drink flavors on every dispensing valve so that an operator, by looking at a specific indicator, can access the appropriate dispensing valve to obtain the desired flavored drink. These indicators are often obscured by the other products that display visual merchandising information which may be cluttered around and/or on the beverage dispenser, thus, limiting the beverage dispenser's ability to convey its own message. As such, today's beverage dispensers are not configured to convey merchandising information to a large number of customers, especially through audio means.

Accordingly, a beverage dispenser that clearly and distinctly indicates merchandising information to a large number of customers is highly desirable.

SUMMARY OF THE INVENTION

In accordance with the present invention, an audio dispensing valve for a beverage dispenser, includes a valve for regulating fluid flow through the audio dispensing valve and a switch in operative engagement with the valve for selectively activating the valve. The audio dispensing valve includes an audio unit linked with the switch for providing audio information as the switch and the valve are activated.

The audio unit includes a sensor linked with the switch for activating the audio unit via a trigger signal generated thereof. Accordingly, the switch activates the valve as well as activates the audio unit's audio message via the trigger signal from the current sensor. The audio unit thus emits audible information via a sonic generator assembly linked with the sensor.

In particular, the sonic generator assembly includes an audio message memory unit for storing an audio message featuring audible information. On receiving the trigger signal, an audio control logic unit linked with the sensor and the audio message memory unit generates an acoustic signal. As such, the audio control logic unit retrieves the audio message from the audio message memory unit and places the audio message in a recognizable format for an acoustic signal emitter provided by the sonic generator assembly. The acoustic signal emitter linked with the audio control logic unit thus projects the acoustic signal from the audio dispensing valve via an audio amplifier and a loudspeaker. Additionally, a volume adjustment linked with the sonic generator assembly may be included for adjusting the output volume of the acoustic signal projected from the audio dispensing valve.

The acoustic signal emitter specifically includes the audio amplifier electrically linked with the audio logic control unit for receiving the acoustic signal from the audio control unit. The loudspeaker electrically linked with the audio amplifier is provided, whereby the audio amplifier provides sufficient power to the acoustic signal to drive the loudspeaker so that the acoustic signal is projected from the audio dispensing valve.

In accordance with the present invention, a method for providing audible information from an audio dispensing valve, includes storing an audio message containing audible information within an audio unit. The audio unit is linked with a switch and is thus activated by the switch. As such, an acoustic signal is generated by the audio unit and is projected from the audio dispensing valve via the audio unit. A volume adjustment may be linked with the audio assembly for adjusting output volume of the acoustic signal projected from the audio unit.

It is therefore an object of the present invention to provide a dispensing valve and associated method for clearly and distinctly providing audible information therefrom.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various form; the figures are not necessarily to scale; and some features may be exaggerated to show details of particular components or steps.

Figure 1:
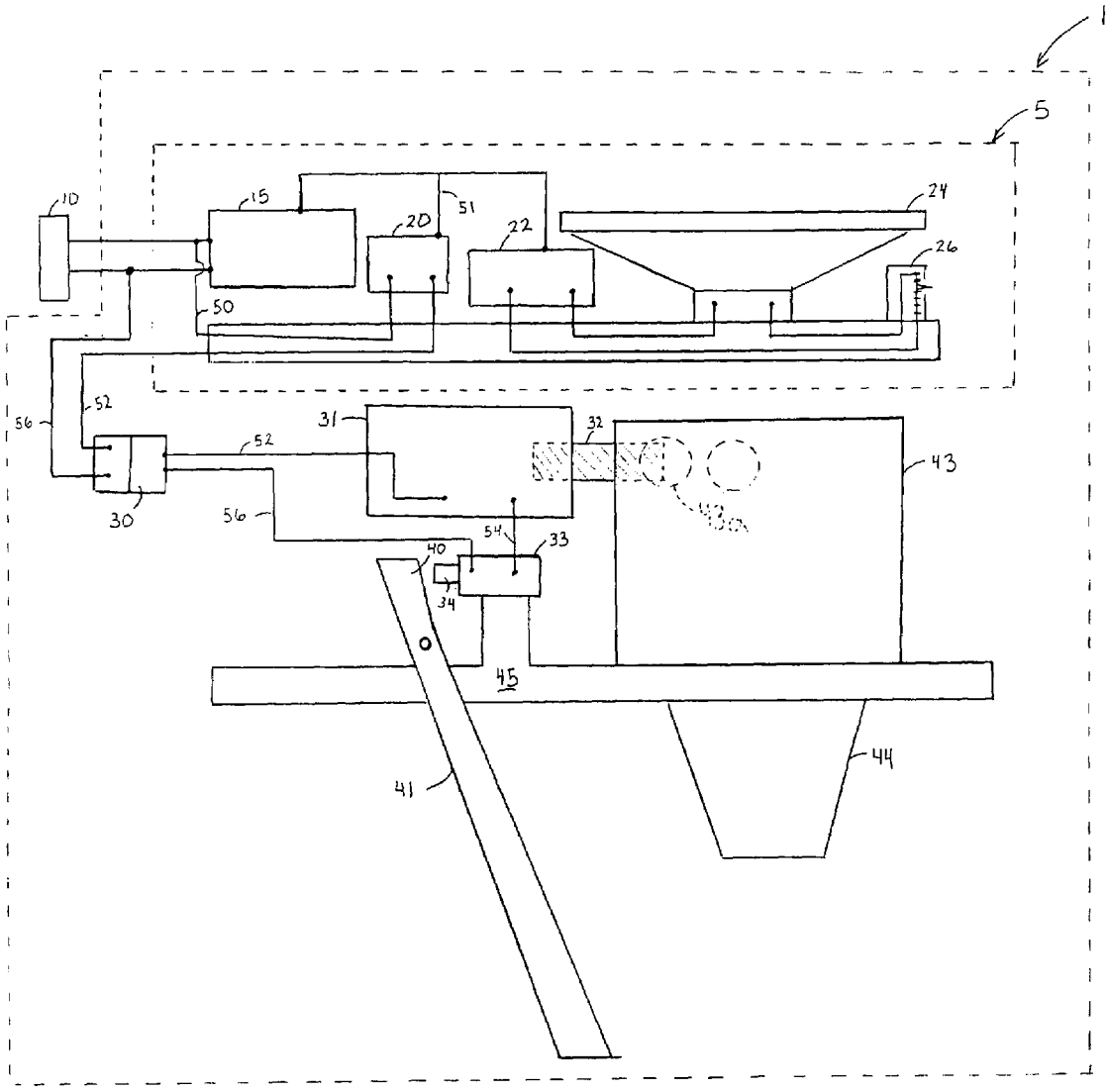
FIG. 1 is a side view illustrating an audio dispensing valve for a beverage dispenser according to the preferred embodiment.

FIG. 1 depicts an audio dispensing valve 1 for a beverage dispenser (not shown). The audio dispensing valve 1 is electrically linked with a power source 10, such as a generator or standard wall outlet, for receiving power therefrom. In the preferred embodiment, the audio dispensing valve 1 operates on twenty-four volts, stepped down, from the power source 10. Additionally, as discussed in detail below, the audio dispensing valve 1 includes a power supply 15 for powering electronic circuitry.

The audio dispensing valve 1 includes a frame 45 for supporting the audio dispensing valve 1. The audio dispensing valve 1 includes a nozzle 44 secured to the frame 45 for dispensing a desired flavored drink therefrom.

A valve 43 secured to the frame 45 and engagedly linked with nozzle 44 is provided for delivering beverage fluids to the nozzle 44, whereby the beverage fluids combine to form a desired drink. In particular, beverage fluids, such as plain and/or carbonated water as well as beverage flavored syrup, are each delivered from a respective source (not shown) to the valve 43. At least one valve inlet 43*a*, formed by the valve 43, is provided for receiving beverage fluids.

As such, the audio dispensing valve 1 includes a valve actuator 31 for closing and opening the valve 43 by covering and uncovering the valve inlet 43*a* from the flow of beverage fluids therethrough. In the preferred embodiment, the valve actuator 31 comprises a solenoid, whereby a solenoid plunger 32 is configured to cover and uncover the valve inlet 43*a* accordingly.

In operation, the valve actuator 31 is activated when a drink is desired from the audio dispensing valve 1. Fluids are thus pumped from their respective sources to the valve 43. When activated, the solenoid plunger 32 moves from a closed position, normally covering the valve inlet 43*a*, to an open position which uncovers the valve inlet 43*a*, thereby permitting beverage fluids to flow from the valve inlet 43*a* into the valve 43. While flowing from the valve 43 out through the nozzle 44, beverage fluids are combined to form the desired drink.

The audio dispensing valve 1 includes a switch 33 electrically linked with the valve actuator 31 for electrically engaging and disengaging the valve actuator 31. As shown in FIG. 1, the preferred switch 33 includes a contact element 34. The audio dispensing valve 1 further includes a lever interface 41 for engagement with the switch 33.

In particular, the preferred lever interface 41 provides a cam surface 40 for engagement with the contact element 34. If a drink is desired, the lever interface 41 is manually displaced by an operator which, in turn, allows the cam surface 40 to contact and displace the contact element 34. Accordingly, the contact element 34 moves the switch 33 from an electrically open position to an electrically closed position, whereby the valve actuator 31 is engaged and opens the valve 43 in the manner described above.

The audio dispensing valve 1 includes an audio unit 5 electrically linked and in engagement with the valve actuator 31 and the switch 33 for providing audible information therefrom. As shown in FIG. 1, a connector coupling 30 is provided for cooperatively engaging the audio unit 5 with the valve actuator 31 and the switch 33, thereby forming a coupling circuit. Although a connector coupling 30 is preferred, those of ordinary skill in the art will recognize other suitable coupling means.

Figure 2:
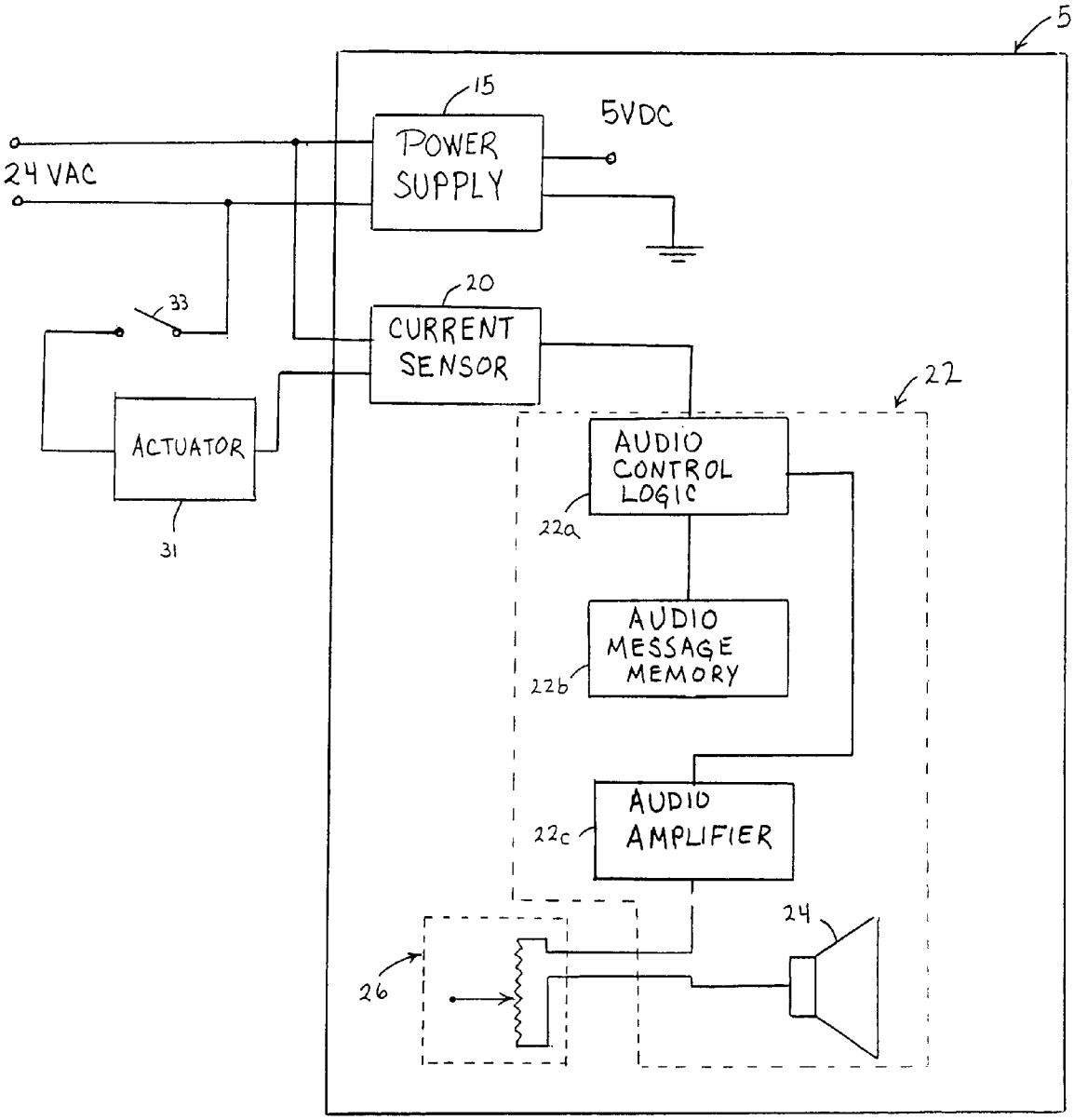
FIG. 2 is a schematic diagram illustrating an audio unit from an audio dispensing valve for providing audible information therefrom.

As shown in FIGS. 1 and 2, the power supply 15, electrically linked with the power source 10, is provided by the audio unit 5 for rectifying voltage associated with the power source 10, preferably rectified to five volts. The power supply 15 provides power for the audio unit 5. Inasmuch, the audio unit 5 includes a current sensor 20 for triggering an audio message from the audio unit 5.

The coupling circuit includes a line 50 for electrically linking the power supply 15 with the current sensor 20, thereby providing the current sensor 20 with a reference voltage. In the preferred embodiment, the current sensor 20 comprises a comparator although those of ordinary skill in the art will recognize other suitable and equivalent means for triggering the audio message. Additionally, the coupling circuit includes a line 52 across connector coupling 30 for electrically linking the power source 10 with the valve actuator 31 and the current sensor 20 via the switch 33. Moreover, the coupling circuit includes a return line 56 across connector coupling 30 for electrically linking the switch 33 with the current sensor 20, thereby providing the current sensor 20 with a response voltage for comparison with the reference voltage. Accordingly, to complete the coupling circuit, the contact element 34 enables the switch 33 from an electrically open position to an electrically closed position, whereby the current sensor 20 generates a resulting trigger signal based on a voltage comparison.

Figure 3:
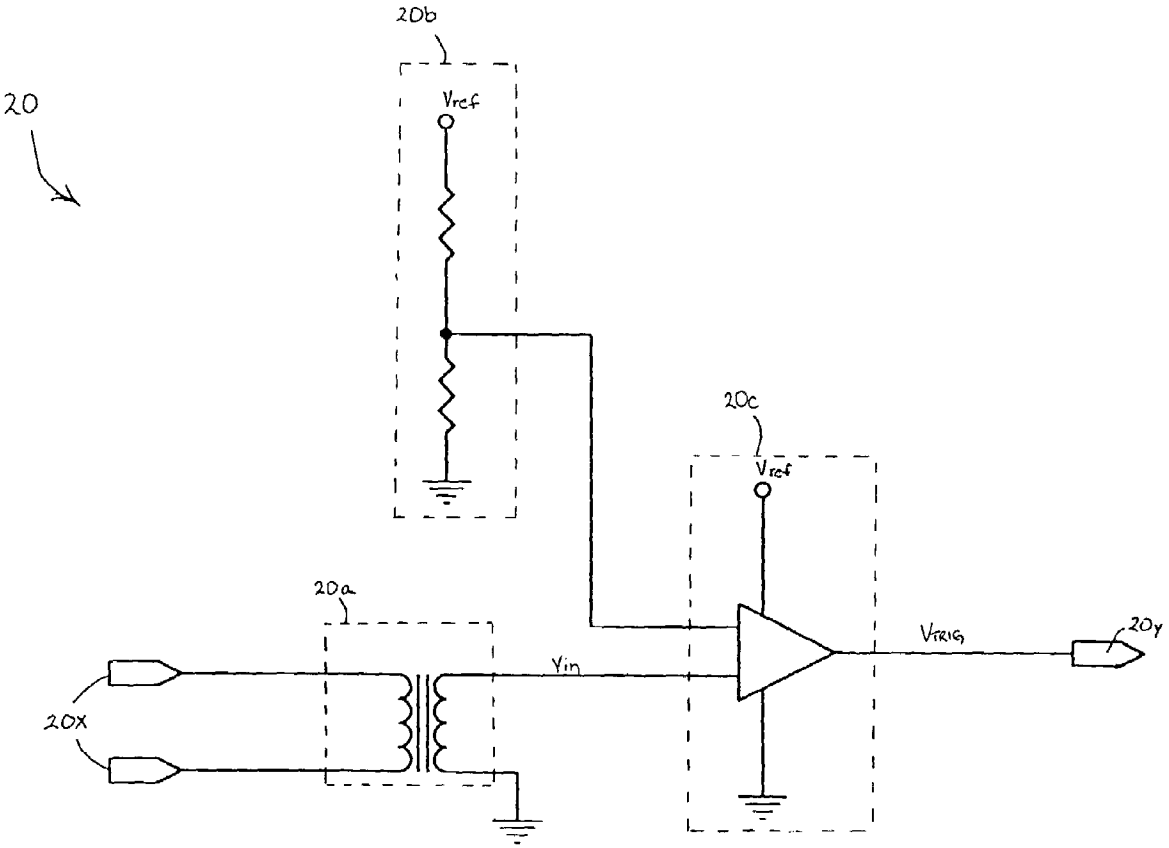
FIG. 3 is a circuit diagram illustrating an exemplary current sensor 20 for voltage comparison and for generating a trigger signal therefrom to activate an audio unit.

Although those of ordinary skill in the art will recognize other sensory means for generating a trigger signal therefrom, FIG. 3 illustrates an exemplary current sensor 20 for voltage comparison. In particular, the current sensor 20 of FIG. 3 includes a comparator 20*c*, preferably an operational amplifier, for comparing a reference voltage, Vref, with a response voltage, Vin. A current divider 20*b* electrically linked with the comparator 20*c* is provided to supply the reference voltage thereto. Moreover, a current transformer 20*a* electrically linked with the switch 33 and with the comparator 20*c* is provided to supply a response voltage indicating to the comparator 20*c* whether the switch 33 has been closed. Thus, the comparator 20*c* generates a trigger signal, Vtrig, if the response voltage, Vref, as compared to the reference voltage indicates that the switch is closed.

Accordingly, in operation, the current sensor 20 receives the reference voltage from the power source 10 via line 50. The power supply 15 provides current to the current sensor 15 as well as the sonic generator assembly 22 via line 51. Current also flows from the power supply 15 through the valve actuator 31 to the switch 33, via lines 52 and 54 respectively. Thus, if a drink is desired, the lever interface 41 is manually displaced by an operator which, in turn, allows the cam surface 40 to contact and displace the contact element 34, thereby closing the switch 33 to complete the coupling circuit. The complete coupling circuit provides enough power to engage the valve actuator 31 to open the valve 43, thereby allowing for a desired drink to be dispensed from the nozzle 44 via the valve 43. Furthermore, the complete coupling circuit establishes a response voltage across return line 56 that is received by the current sensor 20.

The trigger signal is thus generated by the current sensor 20 based on a voltage comparison between the reference voltage and the response voltage. The trigger signal, Vtrig, in turn, triggers an audio message from the audio unit 5. In short, when rendered in a closed position, the switch 33 activates the valve 43 via valve actuator 31 as well as activates the audio unit's 5 audio message via the trigger signal from the current sensor 20.

The audio unit 5 further includes a sonic generator assembly 22 electrically linked with the current sensor 20 for receiving the trigger signal and generating an acoustic signal. As shown in greater detail in FIG. 2, the preferred sonic generator assembly includes an audio control logic unit 22*a* electrically linked with the current sensor 20 for receiving the trigger signal. The preferred audio control logic unit 22*a* comprises a standard microcontroller and associated circuitry linked thereto, such as but not limited to a digital/analog converter or, alternatively, the microcontroller could include a digital to analog converter.

An audio message memory unit 22*b* electrically linked with the audio control logic unit 22*a* is provided for storing the audio message. In the preferred embodiment, the audio message is a prestored digital signal from which information can be conveyed to a large number of beverage consumers, especially merchandising information.

Upon receiving the trigger signal, the audio control logic unit 22*a* retrieves the audio message from the audio message memory unit 22*b*. The audio control logic unit 22*a* then places the audio message into a format suitable for an acoustic signal emitter provided by the sonic generator assembly 22. In particular, the audio message is converted from a digital signal to an audio analog or "acoustic" signal by the audio control logic unit 22*a*, via a digital/analog converter. The acoustic signal emitter then projects the acoustic signal from the audio dispensing valve 1 in a manner so that the acoustic signal is recognized as the audio message stored in the audio message memory unit 22*b*.

Those of ordinary skill in the art will recognize that the acoustic signal emitter may by any suitable means, such as an electronic reed. In the preferred embodiment, the acoustic signal emitter comprises an audio amplifier 22*c* that is electrically linked with the audio control logic unit 22*a* and a loudspeaker 24 electrically linked to the audio amplifier 22*c*. The audio amplifier 22*c* provides sufficient power to the acoustic signal to drive the loudspeaker 24, thereby broadcasting the audio message over an area surrounding the loudspeaker 24. As shown in FIGS. 1 and 2, the audio unit 5 may include a volume adjustment 26 electrically interposed with the audio amplifier 22*c* and the loudspeaker 24 for adjusting the output volume of the acoustic signal emitted by the audio amplifier 22*c*, thereby ultimately adjusting the volume of the audio message broadcasted by the loudspeaker 24.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A dispensing valve for a beverage dispenser, comprising:

a valve for regulating beverage fluid flow through the dispensing valve;

a switch in operative engagement with the valve for selectively activating the valve; and an audio unit, comprising:

a sonic generator assembly for providing audible information therefrom, and a current sensor comprising a comparator, a current divider and a current transformer, wherein the current sensor is linked with the sonic generator assembly and with the switch, wherein the current sensor activates the sonic generator assembly responsive to the switch activating the valve.

2. The dispensing valve according to claim 1 wherein the sonic generator assembly is activated and deactivated in cooperative engagement with the switch as the switch selectively activates the valve.

3. The dispensing valve according to claim 1 wherein the sonic generator assembly comprises:

an audio message memory unit for storing an audio message;

an audio control logic unit linked with the current sensor and the audio message memory unit for receiving an activation signal from the current sensor and generating an acoustic signal thereof; and an acoustic signal emitter linked with the audio control logic unit for projecting the acoustic signal from the dispensing valve.

4. The dispensing valve according to claim 3 wherein the audio control logic unit retrieves the audio message from the audio message memory unit and places the audio message in a recognizable format for the acoustic signal emitter.

5. The dispensing valve according to claim 3 wherein the acoustic signal emitter comprises:

an audio amplifier electrically linked with the audio control logic unit for receiving the acoustic signal from the audio control logic unit; and a loudspeaker electrically linked with the audio amplifier, whereby the audio amplifier provides sufficient power to the acoustic signal to drive the loudspeaker so that the acoustic signal is projected from the dispensing valve.

6. The dispensing valve according to claim 3 wherein the audio unit further comprises a volume adjustment linked with the sonic generator assembly for adjusting output volume of the acoustic signal projected from the dispensing valve.

7. A method for providing audible information from a dispensing valve, comprising:

providing a valve for regulating beverage fluid flow through the dispensing valve;

providing a switch in operative engagement with the valve for selectively activating the valve;

providing an audio unit, comprising:

a sonic generator assembly for providing audible information therefrom, and a current sensor comprising a comparator, a current divider and a current transformer, wherein the current sensor is linked with the sonic generator assembly and with the switch;

storing an audio message containing audible information within the sonic generator assembly;

activating the sonic generator assembly responsive to the current sensor sensing activation of the switch as the switch selectively activates the valve;

generating an acoustic signal with the sonic generator assembly; and projecting the acoustic signal from the dispensing valve via the sonic generator assembly.

8. The dispensing valve according to claim 3 wherein the audio control logic unit is activated and deactivated in cooperative engagement with the switch as the switch selectively activates the valve.

9. The method for providing audible information from a dispensing valve according to claim 7 further comprising linking a volume adjustment with the audio unit for adjusting output volume of the acoustic signal projected from the audio unit.

* * * * *